US006349839B1

(12) United States Patent
Mooney

(10) Patent No.: US 6,349,839 B1
(45) **Date of Patent: *Feb. 26, 2002**

(54) HOT-FILLABLE WIDE-MOUTH GRIP JAR

(75) Inventor: Michael R. Mooney, Wrightsville, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,302

(22) Filed: Dec. 17, 1999

Related U.S. Application Data

(60) Provisional application No. 60/148,872, filed on Aug. 13, 1999.

(51) Int. Cl.[7] ..... B65D 23/00; B65D 90/02

(52) U.S. Cl. ..... 215/384; 215/382; 220/669

(58) Field of Search ..... 215/384, 382, 215/381; 220/675, 669

(56) References Cited

U.S. PATENT DOCUMENTS

| | | | | | |
|---|---|---|---|---|---|
| D277,551 | S | * | 2/1985 | Kerr | D9/367 |
| D279,167 | S | * | 6/1985 | Haney et al. | D9/378 |
| 4,804,097 | A | | 2/1989 | Alberghini et al. | 215/100 A |
| 4,890,752 | A | | 1/1990 | Ota et al. | 215/1 C |
| 4,946,053 | A | | 8/1990 | Conrd | 215/1 C |
| 4,993,565 | A | | 2/1991 | Ota et al. | 215/1 C |
| 5,092,474 | A | | 3/1992 | Leigner | 215/1 C |
| 5,141,120 | A | | 8/1992 | Brown et al. | 215/1 C |
| 5,141,121 | A | | 8/1992 | Brown et al. | 215/100 A |
| 5,148,930 | A | | 9/1992 | Ota et al. | 215/1 C |
| 5,165,557 | A | | 11/1992 | Ota et al. | 215/1 C |
| 5,178,290 | A | * | 1/1993 | Ota et al. | 215/1 C |
| 5,199,587 | A | | 4/1993 | Ota et al. | 215/1 C |
| 5,226,550 | A | | 7/1993 | Mikolaitis et al. | 215/1 C |
| 5,261,544 | A | | 11/1993 | Weaver, Jr. | 215/1 C |
| D344,457 | S | | 2/1994 | Prevot et al. | D9/537 |
| D354,685 | S | | 1/1995 | Krishnakumar et al. | D9/543 |
| 5,392,937 | A | | 2/1995 | Prevot et al. | 215/1 C |
| 5,472,105 | A | | 12/1995 | Krishnakumar et al. | 215/384 |
| 5,598,941 | A | | 2/1997 | Semersky et al. | 215/384 |
| D379,763 | S | | 6/1997 | Ewing, Jr. | D9/520 |
| D382,485 | S | | 8/1997 | Krishnakumar et al. | D9/543 |
| D382,807 | S | | 8/1997 | Silvers et al. | D9/520 |
| D385,497 | S | | 10/1997 | Krishnakumar et al. | D9/543 |
| D393,210 | S | | 4/1998 | Ewing, Jr. | D9/543 |
| 5,758,790 | A | | 6/1998 | Ewing, Jr. | 215/384 |
| D420,593 | S | | 2/2000 | Denner et al. | D9/520 |

* cited by examiner

*Primary Examiner*—Nathan J. Newhouse
*Assistant Examiner*—Joseph C. Merek
(74) *Attorney, Agent, or Firm*—Howson and Howson

(57) ABSTRACT

A hot-fillable wide-mouth jar having an opposed pair of collapse panels that move inwardly to accommodate vacuum-induced volumetric shrinkage of the jar. The jar includes a sidewall having front and rear label panels each of a predetermined radius of curvature and each of a predetermined arcuate extent. A pair of arcuate collapse panels are located between the front and rear label panels, and each has a predetermined arcuate extent and an inset grip region affording facile handling of the jar. Desirable structural parameters are disclosed.

8 Claims, 5 Drawing Sheets

30
28
24
42
46
36
58
$A_{cp}$
w
l
52
G
32
$A_g$
50
54
44
48
26
28
30

HOT-FILLABLE WIDE-MOUTH GRIP JAR

This Appln claims benefit of Prov. No. 60/148,872 filed Aug. 13, 1999.

FIELD OF THE INVENTION

The present invention relates to hot-fillable containers, and more particularly, the present invention relates to hot-fillable wide-mouth jars having collapse panels with integral grips.

BACKGROUND OF THE INVENTION

In the early 1990s, Graham Packaging Company pioneered the development of a hot-fillable container that incorporated opposed collapse panels having grip regions that both accommodated the requisite vacuum absorption requirements of hot-fill processing and afforded facile handling of the container by the consumer. The commercialized container is disclosed in U.S. Pat. Nos. 5,392,937; 5,598,941; and D.344,457. It is particularly suited for containing liquids, such as juices.

In recent years, Graham pioneered the development of hot-fill wide-mouth jars particularly suited for containing viscous food products, such as sauces. The hot-filling of such products has presented new challenges to designers due to the higher fill temperatures and greater product densities encountered. An example of one of Graham's patented hot-fill wide mouth jars is disclosed in U.S. Pat. No. 5,887,739. This patented jar has a generally cylindrical body with a plurality of peripheral collapse panels that accommodate the requisite vacuum absorption and volumetric shrinkage in hot-fill processing. A variation of this jar having grips is disclosed in Graham's co-pending application Ser. No. 09/466,698, filed concurrently herewith, titled "Hot-Fillable Grip Container". While the above jars have functioned satisfactorily for their intended purposes, there is a need for a wide-mouth, hot-fill jar that can be manufactured efficiently in various capacities.

OBJECTS OF THE INVENTION

With the foregoing in mind, a primary object of the present invention is to provide a novel wide-mouth grip jar for hot-fill applications that is an improvement over the aforementioned patented jars.

Another object of the present invention is to provide an improved wide-mouth grip jar for hot fill applications that provides enhanced vacuum absorption capabilities with a minimum of structural elements such as ribs, grooves and the like which detract from production efficiency, as well as the appearance of the container.

A further object of the present invention is to provide a wide mouth grip jar for hot-fill applications that functions well under hot-fill processing conditions for viscous food products, such as sauces.

SUMMARY OF THE INVENTION

More specifically, the present invention provides a wide mouth grip jar for hot-fill applications that comprises a dome, a base, and a sidewall extending between the dome and the base. The sidewall has diametrically opposed front and rear label panels and opposed collapse panels disposed between the label panels. Each collapse panel has an inset grip region that affords facile gripping of the container by the consumer.

Each of the label panels has a predetermined transverse radius of curvature throughout its arcuate extent, and each of the collapse panels has, throughout its arcuate extent, a predetermined radius of curvature which is larger than the radius of curvature of each label panel. The upper and lower vertical extremities of the collapse panel extend along structural stiffeners, such as a groove below the dome and a label bumper above the base. Each of the collapse panels is bordered by vertical transitional zones located at the juncture of each collapse panel with the front and rear label panels. Preferably, the front label panel is provided with a series of horizontally extending grooves and lands. The overall container is characterized by a minimum of structural elements that improve the container's appearance. Certain structural relations desirable to achieve these functions are disclosed.

BRIEF DESCRIPTION OF THE DRAWINGS

The foregoing and other objects, features and advantages of the present invention become apparent from the following description when taken in conjunction with the accompanying drawings, in which.

DETAILED DESCRIPTION OF PREFERRED EMBODIMENTS

Figure 1:
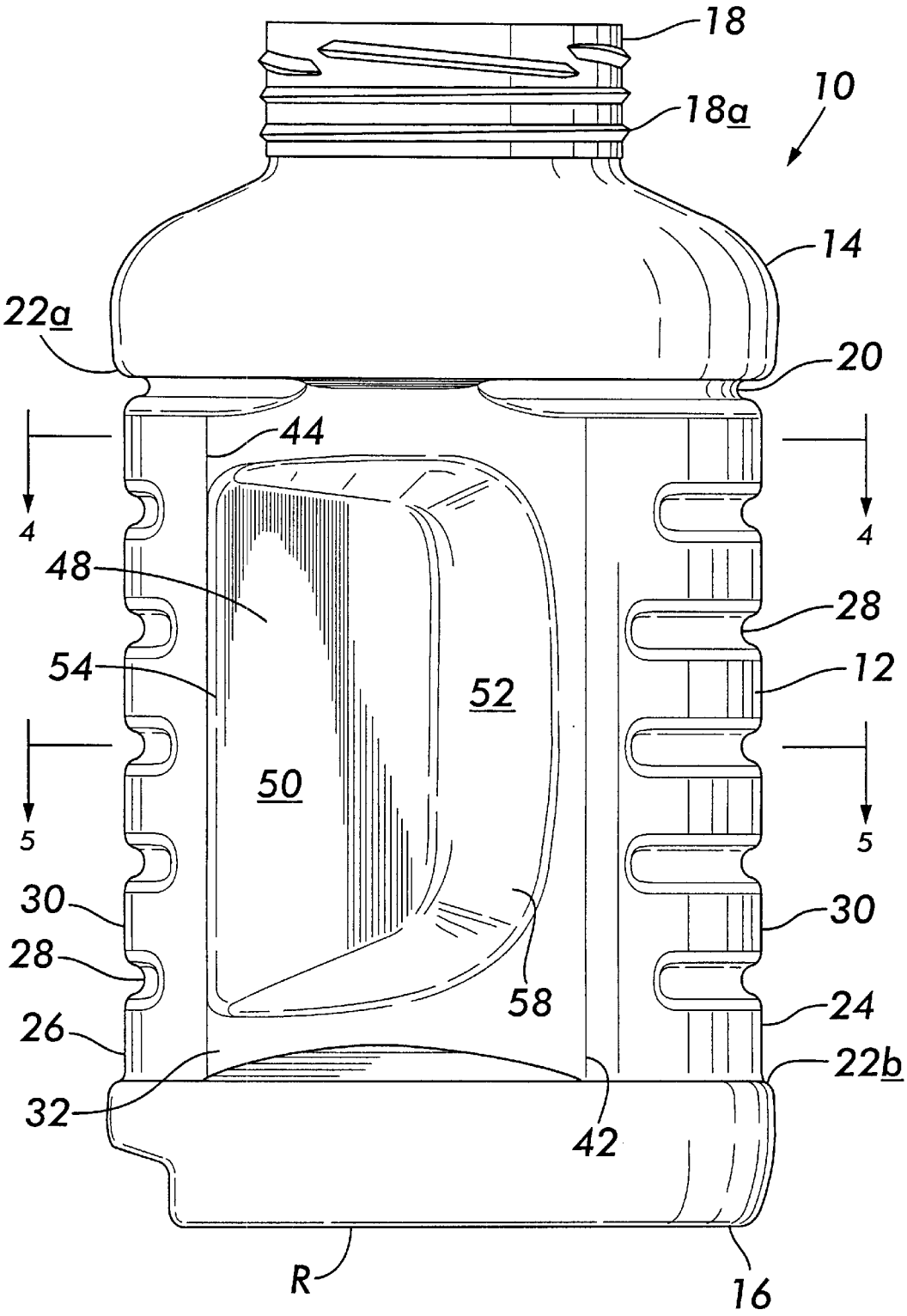
FIG. 1 is a side elevational view of a wide-mouth jar embodying the present invention.

The jar 10 of the present invention illustrated in FIGS. 1–6 is particularly suited for hot-fill packaging of viscous food products, such as sauces. As discussed above, such food products present unique challenges to container designers due to the higher fill temperatures (up to 205° F.) and the greater ambient temperature densities, of the filled products which are on the order of $1.05^{+}$ g/cm$^3$. The unique construction of the sidewall 12 of the jar 10 enables the jar to accommodate vacuum-induced volumetric shrinkage caused by hot-filling while affording a consumer-friendly package that is easy to grip with one hand.

Structurally, the jar 10 has a dome 14 and a base 16 that extend integrally from opposite ends of the sidewall 12. Preferably, the dome 14 has an upstanding wide-mouth finish 18 with a peripheral flange 18*a*. The dome 14 is circular in transverse cross-section adjacent the sidewall 12, and interconnects with the sidewall 12 via a peripheral groove 20 that extends inwardly below an upper label bumper 22*a* at the base of the dome 14. Preferably, the base 16 is coaxial with the dome 14, is circular in transverse cross-section adjacent the sidewall 12, and interconnects with sidewall 12 via a peripheral lower label bumper 22*b*. While a preferred dome and a preferred base are illustrated in the drawings, other dome and base configurations can be utilized with the novel sidewall 12 of the present invention.

Figure 4:
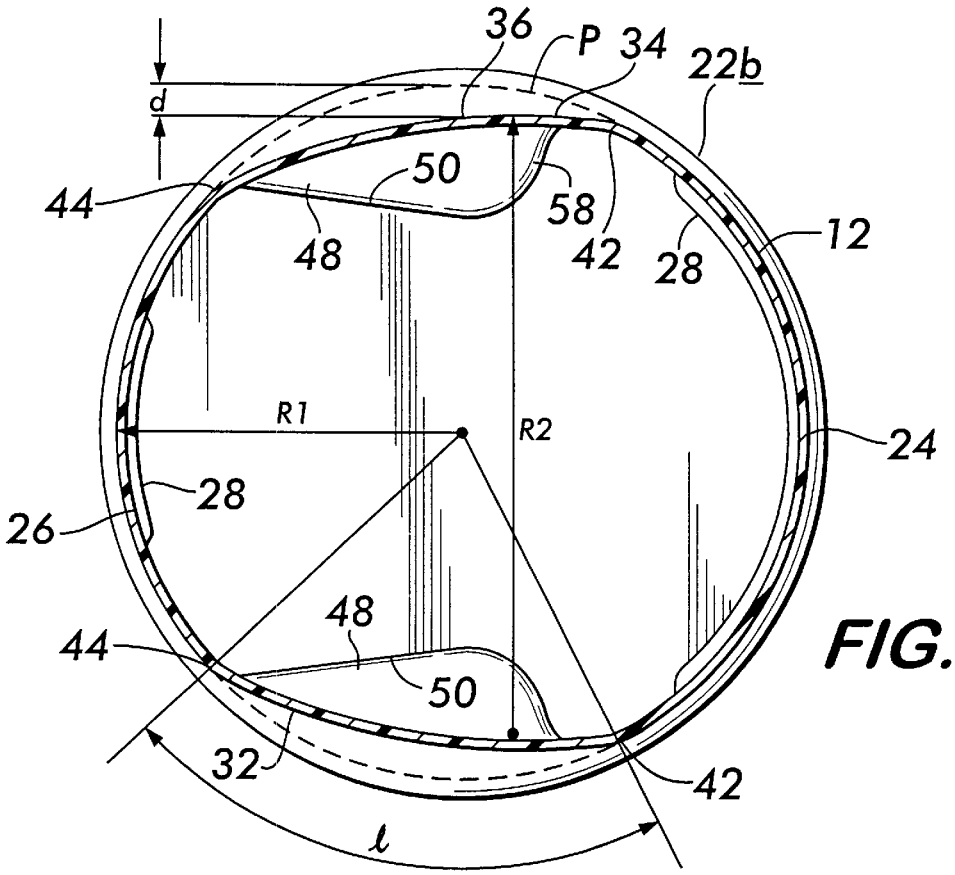
FIG. 4 is a cross-sectional view of the wide-mouth jar illustrated in FIG. 1 taken on line 4—4.
Figure 5:
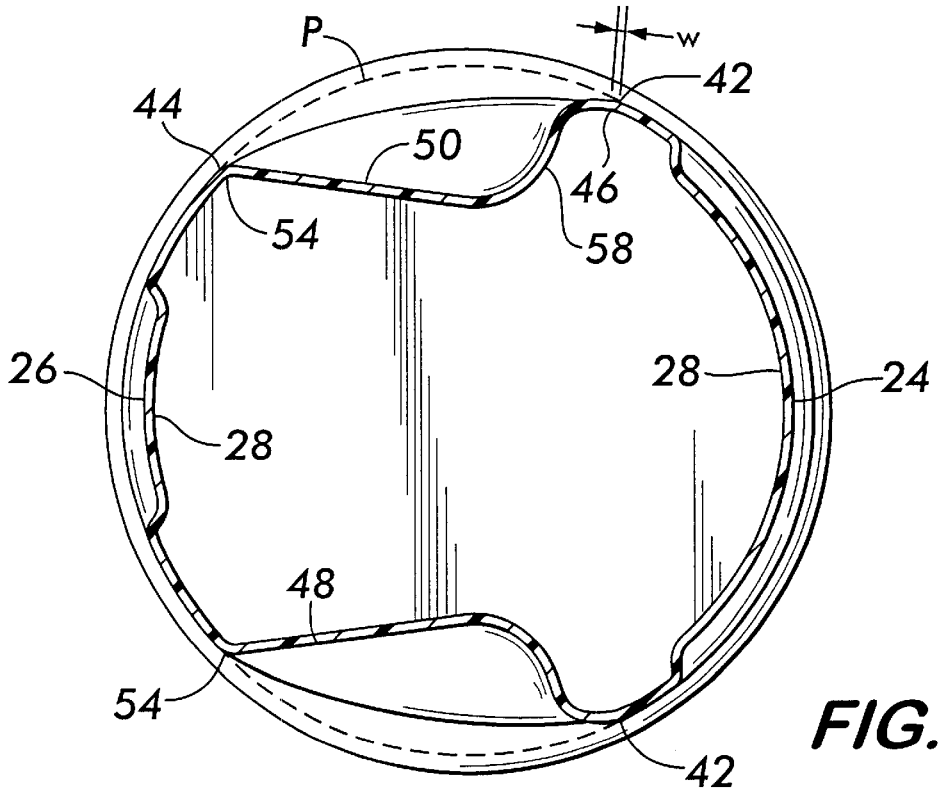
FIG. 5 is a cross-sectional view of the wide-mouth jar illustrated in FIG. 1 taken on line 5—5.
Figure 6:
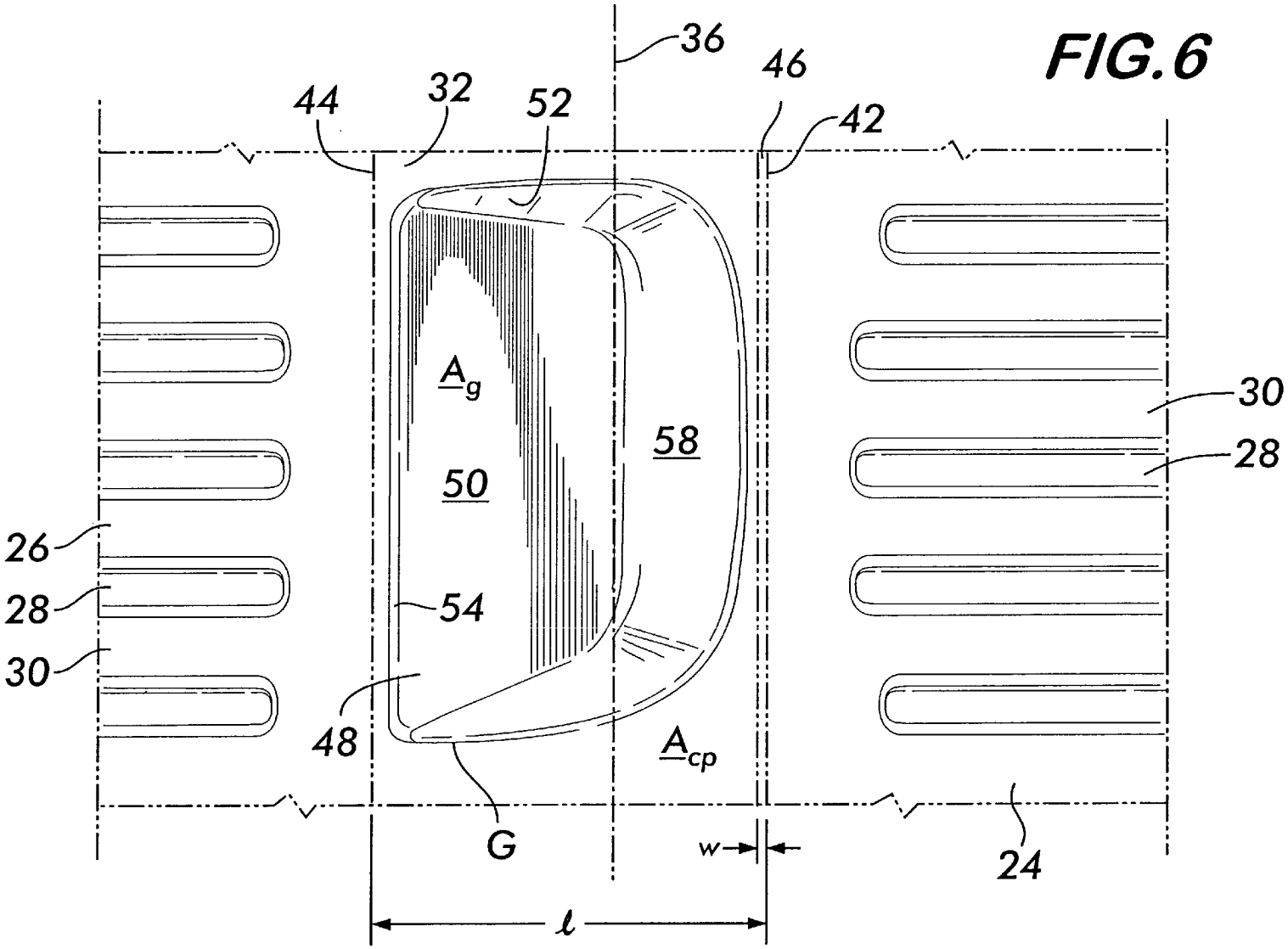
FIG. 6 is a fragmentary, developed view of a 180° section of the sidewall between the middle of the front and rear label panels.

A unique aspect of the jar 10 is that the sidewall 12 comprises different arcuate sections with different radii of curvature. To this end, the sidewall 12 has an arcuate front label panel 24 located opposite an arcuate rear label panel 26. The two label panels are interconnected by a pair of identical, arcuate unframed collapse panels, 32 and 34. These four panels are all generally rectangular and convex. Together the label and collapse panels form a continuous, integral circumferential sidewall 12. The label panels, 24 and 26, and the collapse panels, 32 and 34, have different radii of curvature. Thus, while the sidewall 12 may appear substantially cylindrical, the sidewall 12 is not actually circular in transverse cross-section. Rather, as illustrated in FIG. 4, a cylindrical plane "P" passes only through the label panels 24 and 26, while the collapse panels 32 and 34 are inset from that plane.

The different arcuate sections of the sidewall 12 provide different functions. For instance, in response to hot-filling, the arcuate label panels, 24 and 26, resist deformation, while the arcuate unframed collapse panels, 32 and 34, are believed to move inward to accommodate volumetric shrinkage of the container 10. Additionally, the label panels provide support for labels affixed to the container, while the collapse panels support hand grips.

Figure 2:
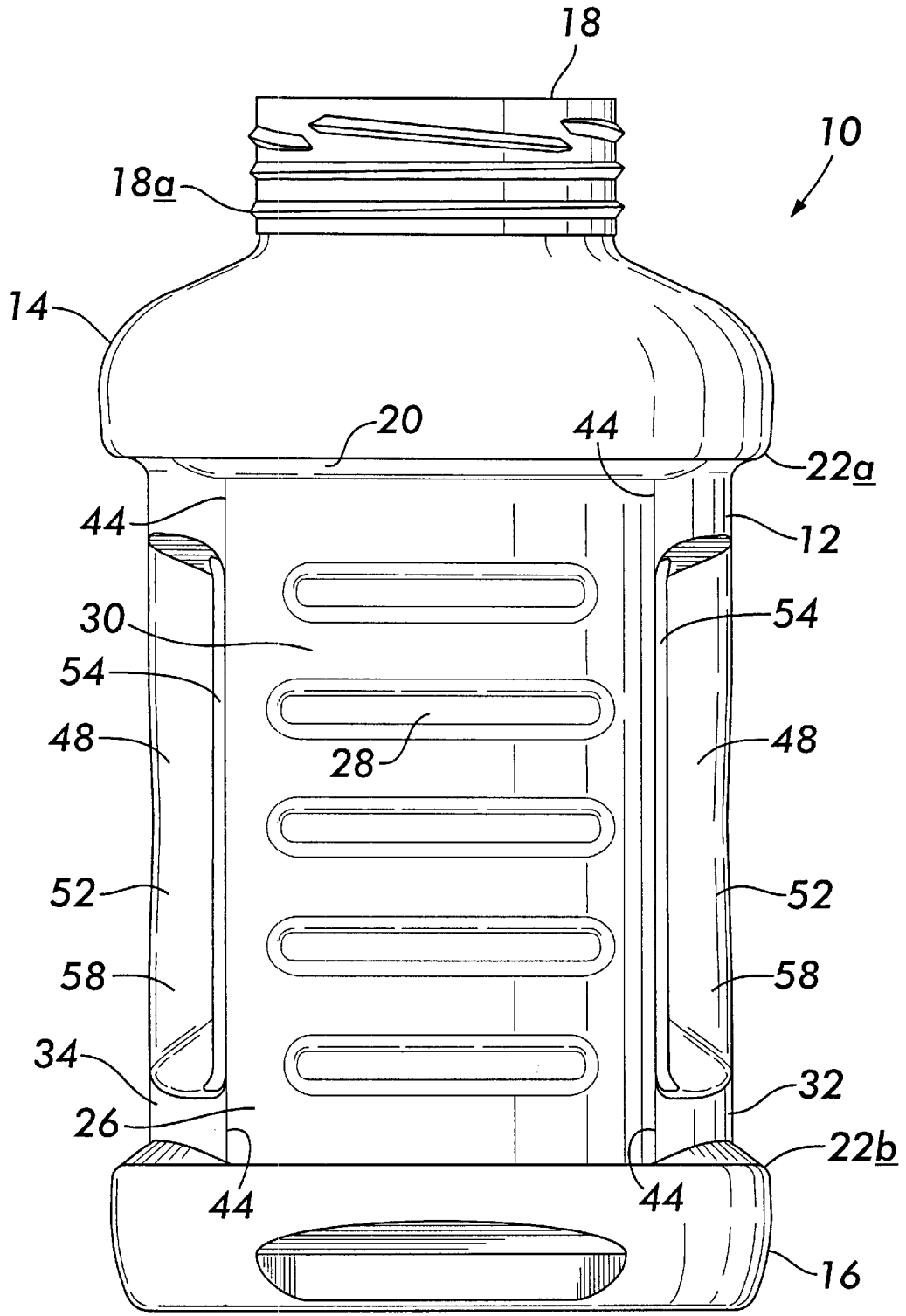
FIG. 2 is a front elevational view of the wide mouth jar illustrated in FIG. 1.
Figure 3:
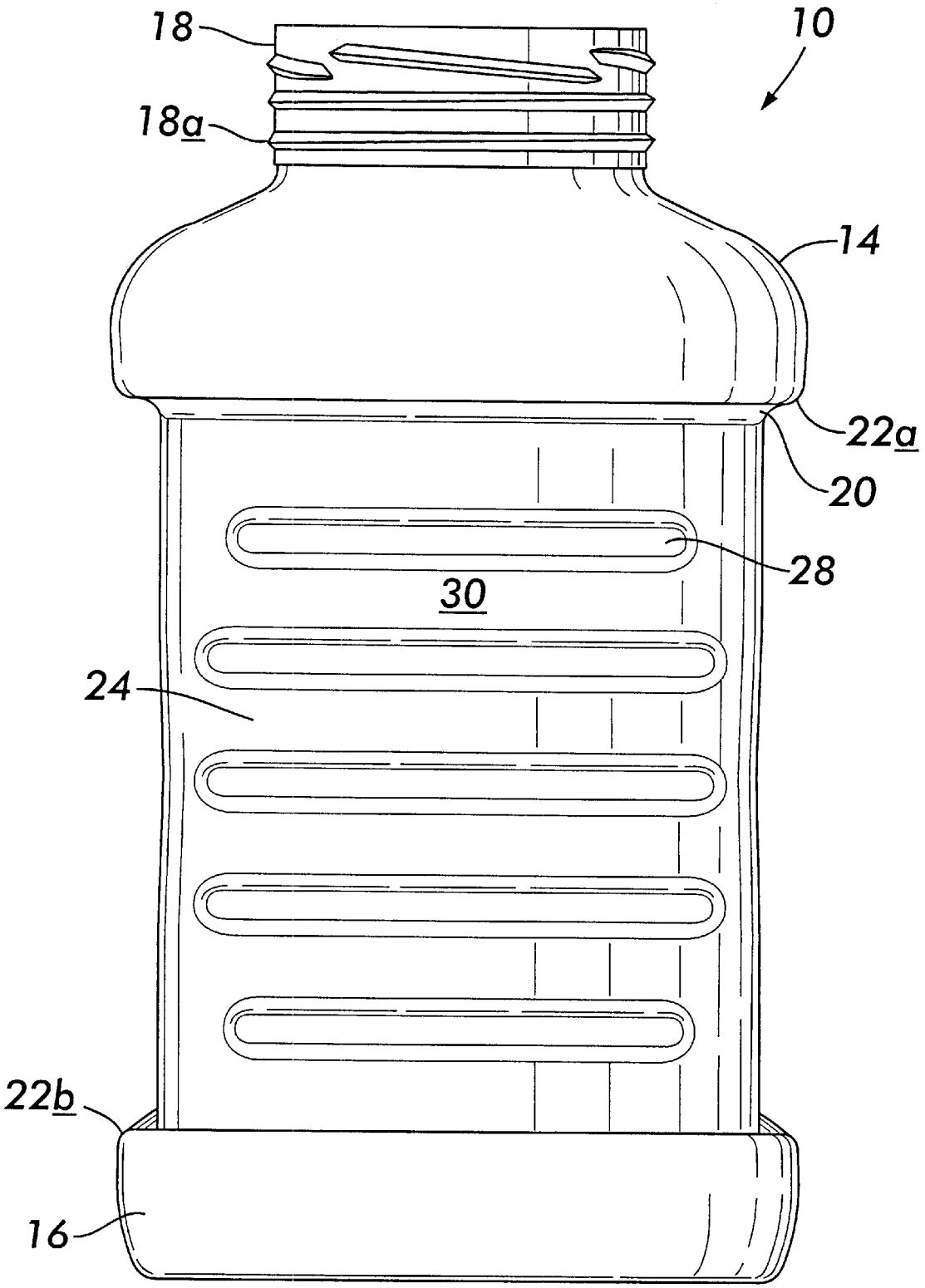
FIG. 3 is a rear elevational view of the wide-mouth jar illustrated in FIG. 1.

As illustrated in FIGS. 2 and 3, the label panels, 24 and 26, extend continuously in a longitudinal direction from the groove 20 below the upper label bumper 22*a* to the lower label bumper 22*b*. As illustrated in FIG. 4, each label panel, 24 and 26, has a predetermined radius of curvature $R_1$, throughout its arcuate extent. Preferably, the arcuate extent of the front label panel 24 is greater than the arcuate extent of the rear label panel 26, and the radius of curvature of each is the same. Preferably, both label panels, 24 and 26, have a plurality of vertically-spaced circumferential stiffening ribs 28 separated by horizontally elongate lands 30. The stiffening ribs 28 rigidify the label panels and resist barreling, also known as ovalization.

An inset grip region 48 is formed in each collapse panel, 32 and 34, to afford facile gripping of the container. Each grip 48 is substantially vertically centered on each collapse panel and is horizontally offset rearwardly on each collapse panel so as to be located closer to the rear label panel 26 than to the front label panel 24. Preferably, each grip 48 includes an inset, trapezoidal-shaped, planar wall portion 50 surrounded by an integral rigid frame 52. Frame 52 includes a vertical rear post 54 that extends adjacent the juncture 44 between the rear label panel 26 and the collapse panel to form a part of a rear vertical transitional zone. Frame 52 also includes a tapered inwardly extending wall portion 58 that extends around the frontal, upper and lower portions of planar wall portion 50 to connect it to the rest of the collapse panel 32, thereby causing the frame and grip to have a generally C-shaped configuration.

The arcuate collapse panels, 32 and 34, extend vertically from the groove 20 below the upper label bumper 22*a* to the lower label bumper 22*b*. As illustrated in FIG. 4, collapse panels 32 and 34 have a predetermined radius of curvature $R_2$ throughout their arcuate extent. The radius of curvature $R_2$ of each collapse panel 32 and 34 is greater than the radius of curvature $R_1$, of label panels 24 and 26. Thus, in transverse cross-section, sidewall 12 does not have a circular shape due to the differences in the radii of curvature, $R_1$ and $R_2$. This is illustrated by the circular dashed line in FIG. 4 and the distance "d" which represents the distance a vertical medial apogee 36 of the collapse panel 34 is inset from the imaginary cylindrical plane "P" passing through the label panels, 24 and 26.

Sidewall 12 is unique because there is little structure associated with the collapse panels as is common with prior art collapse panel containers. See, e.g., U.S. Pat. Nos. 5,141,120, 5,141,121, 5,392,937, 5,472,105. The vertical margins of each of collapse panels 32 and 34 are indistinct because the radius of curvature of the bottle sidewall transitions gradually from that of the label panel to that of the collapse panel.

Zones of transition provide a smooth and continuous change in the radius of curvature of the container wall between the collapse and label panels. As illustrated in FIG. 4, transitional zone 46 has a predetermined arcuate extent "W" located at the juncture 42 of the collapse panel 34 and the front label panel 24. A similar rear transitional zone, of somewhat lesser arcuate extent, is present at the rear label panel juncture 44 above and below the grip post 54.

As formed, collapse panels 32 and 34 are convex and move inwardly toward a somewhat less convex shape in response to vacuum-induced volumetric shrinkage of the hot-filled container. Thus, the collapse panels 32 and 34 accommodate a portion of the volumetric shrinkage without distorting the bottle sidewall by inverting or denting, as in prior art containers. See, e.g. U.S. Pat. Nos. 5,141,121 and 4,877,141.

To achieve the most desirable flexing function there are certain parameters that should be considered carefully, and certain ratios that are believed significant with respect to the performance of the container 10. For instance, the grip, defined by the perimeter line "G" in FIG. 6 should occupy a fraction of the area of each collapse panel. Specifically, for a 45 fl. oz. wide-mouth jar, the grip area in the illustrated container ($A_g$) is 19.3 $in^2$, or about 77% of the total area of the collapse panels ($A_{cp}$), 25.2 $in^2$, thereby providing a Grip Ratio (GR), defined as the ratio of the total collapse panel area of the jar ($A_{cp}$) divided by the area of the grip ($A_g$) ie. $GR=(A_{cp}/A_g)$ of about 1.3:1. The Grip Ratio for this embodiment should be in a range of about 1.2:1 to about 1.4:1.

A Collapse Panel Ratio (CPR), is defined as the total surface area of the container below a finish flange ($A_{tc}$) divided by the area of the collapse panel ($A_{cp}$), i.e., $CPR=(A_{tc})/(A_{cp})$. In the illustrated embodiment, $A_{tc}$ is 126.3 $in^2$. Thus, the CPR is about 5:1 in the preferred embodiment. It is believed that the Collapse Panel Ratio may vary from about 4.5:1 to 5.5:1.

According to the present invention, the optimal collapse panel motion is obtained when the radius of curvature of the collapse panels is almost double that of the label panels. A Collapse Panel Curvature Ratio (CPCR), defined as the radius of curvature $R_2$ of the collapse panel divided by the radius of curvature $R_1$ of a label panel, i.e., $CPCR=R_2/R_1$, is about 1.78:1 in the preferred embodiment. The collapse panel ratio may range from about 1.7:1 to about 1.9:1.

The arcuate extent of each collapse panel 32 and 34 is also important in accommodating the vacuum following hot filling to avoid distortion of the container. The total collapse panel arcuate extent "R" is the arcuate extent of its radius $R_2$ in radians, including the frontal transitional zone "W". In the preferred embodiment, the parameter "R" is on the order of at least about one radian (i.e., an arc subtended by an included angle of about 57°).

The lateral dimension of the frontal zone of transition 46 is also believed to be important to the performance of the container. In the preferred embodiment, lateral dimension "W" of zone of transition 46 is less than about 0.1 inches in arcuate extent, and is most preferably about 0.096 inches in extent. The frontal zone of transition forms approximately 4% of the total peripheral extent of each of the collapse panels, which is 2.38 inches in the illustrated embodiment.

Preferably, the collapse panels, 32 and 34, together, form at least about 40% of the total arcuate extent of sidewall 12.

The area of the base is also believed important to the performance of the container. In the 45 fl. oz. jar illustrated, the area of the base, inside its standing ring "R" (FIG. 1), is preferably about 12 $in^2$, i.e., the base has a diameter of about 3.8 inches. The base push-up region, not shown, is of conventional radial-ribbed design, as well known in the art.

EXAMPLE I

By way of example, and not by way of limitation, one embodiment of the invention provides a wide mouth jar 10 with a capacity of forty five fluid ounces. The jar 10 is illustrated in full scale in the drawings. The dimensional specifications recited below and illustrated in the drawings apply to the as-formed, empty container condition, i.e., after blow-molding but before hot-filling, and in the absence of any internal or external applied forces.

The radius of curvature $R_1$ of each of the label panels 24 and 26 is about 2.03 inches. The radius of curvature $R_2$ of each of the collapse panels 32 and 34 is about 2.39 inches. Sidewall 12 is approximately 4.25 inches in height. Since the height of each label panel and collapse panel is constant, the area of each is essentially determined by its arcuate extent. Each collapse panel has an arcuate extent "R" as illustrated on FIG. 4 of about 74°, i.e., about 1.3 radians.

The rear label panel 26 comprises about 25% of the arcuate extent of the sidewall 12. The front label panel 24 comprises about 35% of the arcuate extent of the sidewall 12. The collapse panels 32 and 34 combine to comprise about 41% of the arcuate extent of the sidewall 12. Preferably, the collapse panels, 32 and 34, including the grips 48, have a combined surface area of about 25.2 $in^2$, and the front label panel 24 has a surface area of about 19.1 $in^2$.

The distance "d" that the medial apogee of collapse panel 34 is inset from the imaginary cylindrical plane "P" through the label panels, 24 and 26, is about 0.19 inch, or about 9% of the radius of curvature $R_1$ of the label panels, 24 and 26. Preferably, the distance "d" is substantially constant throughout the vertical extent of the collapse panel except at the grip 48. The predetermined arcuate extent of the front transitional zone "W" is about 4% of the total arcuate extent of the collapse panel.

While the aforementioned dimensional relations have proven to function satisfactorily, it is believed that some modifications may be possible without significantly adversely affecting the desired performance. Ranges for various parameters are set forth in Table I.

EXAMPLE II

By way of example, and not by way of limitation, another embodiment of the invention provides a wide mouth jar 10 with a capacity of sixty-six fluid ounces. It is similar to the jar 10 illustrated in the drawings. The dimensional specifications recited below and illustrated in the drawings apply to the as-formed, empty container condition, i.e., after blow-molding but before hot-filling, and in the absence of any internal or external applied forces.

The radius of curvature $R_1$ of each of the label panels 24 and 26 is about 2.39 inches. The radius of curvature $R_2$ of each of the collapse panels 32 and 34 is about 3.25 inches. Sidewall 12 is approximately 4.75 inches in height. Since the height of each label panel and collapse panel is constant, the area of each is essentially determined by its arcuate extent. Each collapse panel has an arcuate extent "R" as illustrated on FIG. 4 of about 90°, i.e., about 1.57 radians.

The rear label panel 26 comprises about 20% of the arcuate extent of the sidewall 12. The front label panel 24 comprises about 30% of the arcuate extent of the sidewall 12. The collapse panels 32 and 34 combine to comprise about 50% of the arcuate extent of the sidewall 12. Preferably, the collapse panels, 32 and 34, including the grips 48, have a combined surface area of about 38.4 $in^2$, and the front label panel 24 has a surface area of about 22 $in^2$.

The distance "d" that the medial apogee of collapse panel 34 is inset from the imaginary cylindrical plane "P" through the label panels, 24 and 26, is about 0.21 inch, or about 9% of the radius of curvature $R_1$ of the label panels, 24 and 26. Preferably, the distance "d" is substantially constant throughout the vertical extent of the collapse panel except at the grip 48. The predetermined arcuate extent of the front transitional zone "W" is about 15% of the total arcuate extent of the collapse panel radian. Ranges for various parameters are set forth in Table I.

TABLE I

| | Embodiment | |
|---|---|---|
| Parameter | 45 oz. | 66 oz. |
| $R_1$ (inches) | 2.035 | 2.390 |
| $R_2$ (inches) | 3.630 | 3.25 |
| l (radians) | 1.3 | 1.6 |
| d (inches) | 0.189 | 0.214 |
| (range) | (0.170–0.208) | (0.193–0.235) |
| W (inches) | 0.096 | 0.535 |
| (range) | (0.085–0.115) | (0.48–0.58) |
| (Collapse Panel Ratio) CPR | 5:1 | 4.2:1 |
| (range) | (4.5–5.5:1) | (3.8–4.6:1) |
| (Grip Ratio) GR | 1.3:1 | 1.43:1 |
| (range) | (1.2–1.4:1) | (1.3–1.6:1) |
| (Collapse Panel Curvature Ratio) CPCR | 1.78:1 | 1.36:1 |
| (range) | (1.7–1.9:1) | (1.25–1.5:1) |

Various modifications to the jar are contemplated. For instance, the shape and location of the inset grip regions can be modified as well as the shapes of the dome and base. The jar can be made smaller or larger, and it can be made of PET or like thermoplastic material. In addition, while the groove 20 and lower label bumper **22*b* provide peripheral stiffening structures, stiffening structures other than the horizontal groove 20 and lower label bumper 22*b*** providing an equivalent function at similar locations may be used.

In view of the foregoing it should be apparent that the present invention provides a hot-fill grip jar that is facile to handle, that is suitable for hot filling with viscous food products at temperatures up to 205° F., and that can be blow molded efficiently.

While a preferred embodiment of a hot-fillable, grippable container has been described, various modifications, alterations, and changes may be made without departing from the spirit and scope of the present invention as defined in the appended claims.

What is claimed is:

1. A hot-fillable wide-mouth grip jar, comprising:

a dome with a wide-mouth finish, said dome having a lower portion with a circular transverse cross-section;

a base having an upper portion with a circular transverse cross-section located below said dome and coaxially therewith, a sidewall extending between said dome and base portions, said sidewall having diametrically opposed front and rear label panels and opposed collapse panels disposed between said label panels, each collapse panel having an inset grip region affording facile gripping of the container;

each of said label panels having a predetermined transverse radius of curvature throughout its arcuate extent for providing an inwardly concave surface;

each of said collapse panels having throughout its arcuate extent a predetermined radius of curvature greater than either of said label panels for providing an inwardly concave surface;

the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones;

the vertical extent of each of said collapse panels being defined by a continual arcuate upper peripheral stiffener subjacent said dome lower portion and a continual lower peripheral stiffener located superadjacent said base upper portion such that each collapse panel merges into said upper and lower peripheral stiffeners;

said collapse panel moving inward in response to forces developed in the jar in response to hot-filling with a liquid, capping and cooling; and each of said grip regions being offset rearwardly in its collapse panel so as to be located closer to said rear label panel than to said front label panel, and each of said front transitional zones forming a wide generally C-shaped, inwardly-concave smooth wall portion extending around a substantial portion of said grip region.

2. A jar according to claim 1, wherein each frontal transitional zone has a predetermined arcuate extent which is at least about 4% and less than about 15% of the total arcuate extent of the collapse panel.

3. A jar according to claim 1, wherein each of said collapse panels has a vertical medial apogee inset from an imaginary cylindrical plane extending vertically through both front and rear label panels.

4. A jar according to claim 3, wherein said collapse panel vertical medial apogee is inset radially about 9% of the radius of curvature of said cylindrical plane.

5. A jar according to claim 4, wherein the magnitude of inset of said vertical medial apogee is substantially constant throughout its vertical extent and is less than about one-quarter inch.

6. A jar according to claim 5, wherein each of said grip regions has a planar wall portion of generally trapezoidal shape with a base extending vertically contiguous with said rear label panel for substantially less than the vertical distance between said upper and lower stiffeners with the remaining vertical distance being provided by said rear transitional zone which is smaller in arcuate extent than said front transitional zone.

7. A jar according to claim 1, wherein said upper peripheral stiffener includes a peripheral groove subjacent said dome, and said lower peripheral stiffener includes a lower label bumper superadjacent said base.

8. A jar according to claim 1, wherein at least said front label panel has a plurality of vertically-spaced horizontally extending grooves with similarly extending lands therebetween.

* * * * *

UNITED STATES PATENT AND TRADEMARK OFFICE

CERTIFICATE OF CORRECTION

PATENT NO. : 6,349,839 B1
DATED : February 26, 2002
INVENTOR(S) : Mooney

It is certified that error appears in the above-identified patent and that said Letters Patent is hereby corrected as shown below:

Column 8,
Line 19, replace "claim 5," with -- claim 1, --.

Signed and Sealed this

Eleventh Day of March, 2003

JAMES E. ROGAN
*Director of the United States Patent and Trademark Office*